United States Patent [19]

Dykes

[11] 4,350,977

[45] Sep. 21, 1982

[54] ADAPTER FOR BURGLAR ALARM SWITCH

[76] Inventor: Coy M. Dykes, P.O. Box 572, LaFayette, Ga. 30728

[21] Appl. No.: 306,388

[22] Filed: Sep. 28, 1981

[51] Int. Cl.[3] ..... G08B 13/08

[52] U.S. Cl. ..... 340/545; 200/61.93

[58] Field of Search ..... 200/61.93, 61.81, 61.82; 340/545

[56] References Cited

U.S. PATENT DOCUMENTS

| | | | |
|---|---|---|---|
| 1,077,877 | 11/1913 | Fitch . | |
| 2,150,873 | 3/1939 | Schultz | 200/61.82 |
| 2,656,427 | 10/1953 | Fiorucci | 200/61.82 |
| 2,786,911 | 3/1957 | Morgan | 200/61.79 |
| 2,856,477 | 10/1958 | Schultz | 200/61.79 |
| 2,873,333 | 2/1959 | Jacaman | 200/169 |
| 2,875,290 | 2/1959 | Shattow | 200/61.82 |
| 3,516,036 | 6/1970 | Lea | 335/207 |
| 3,768,087 | 10/1973 | Kaye et al. | 340/545 |

*Primary Examiner*—Glen R. Swann, III

*Attorney, Agent, or Firm*—George A. Loud

[57] ABSTRACT

An adapter, intended to be mounted on a door edge opposite a jamb mounted make and break switch of the push-button type, is disclosed. The adapter includes a slidable plate member and a bracket which provides a trackway for the sliding movement of the plate member between an upper position where the plate engages the push-button switch and holds it depressed when the door is closed and a lower position where the plate uncovers a push-button receiving aperture upon opening of the door so that, when the door is reclosed, the push-button enters the aperture and remains in an extended, alarm-actuating position. The adapter further includes a retaining spring which may be selectively positioned to hold the plate member in the upper position while the door is opened and released after closing.

6 Claims, 6 Drawing Figures

ADAPTER FOR BURGLAR ALARM SWITCH

BACKGROUND OF THE INVENTION

1. Field of the Invention

The present invention relates to a wired perimeter burglar alarm system and to an adapter for use in conjunction with a push-button type switch incorporated into the circuit of the system, the adapter functioning to permit the push-button switch to extend to an alarm-actuating position upon an unauthorized entry through a door and to remain in that alarm-actuating position upon reclosing the door.

2. The Prior Art

There are two major categories of burglar alarm systems: perimeter protectors and motion detectors. Each type of system has its own advantages and disadvantages. Motion detectors employ an energy transmitter and receiver to establish an energy path which is broken by an object passing therethrough, resulting in the sounding of some form of alarm. Motion detectors utilizing visible light, ultrasonic energy, infrared radiation and microwave have all been marketed. They offer the advantage that they are simply installed without the necessity of wiring but they also have serious shortcomings in that they allow a burglar to enter inside a home before sounding the alarm and are easily inadvertently triggered by the movement of pets. Once activated, they restrict movement of the homeowner's family within the home.

The significant disadvantage of the perimeter wired system is its cost and difficulty of installation. The most costly component of a perimeter wired system is the control module. One function of the control module is to maintain the sounding of an alarm once the perimeter is violated. In other words, when the perimeter is violated in such a way that a switch in the alarm system circuit is, for example, opened in the case of a normally closed circuit, the alarm cannot be quieted simply by reclosing the switch, as by reclosing a door through which entry was obtained—the control module functions to maintain the alarm, once tripped, until the control module is properly reset.

SUMMARY OF THE INVENTION

The present invention resides in the discovery of a simple mechanical adapter which can be used in conjunction with a conventional push-button type switch commonly used in wired perimeter burglar alarm systems and which provides a function whereby the alarm cannot be quieted by reclosing a door through which entry is gained. Thus the present invention also provides for a wired perimeter burglar alarm system in which the need for a control module is obviated.

Accordingly, the present invention provides a device for mounting, for example, on a door edge opposite a push-button type make and break switch of the spring-loaded, push-button type, mounted in the door jamb. The device includes a plate member and a mounting bracket providing a trackway for sliding movement of the plate member between first and second positions. In the first position the plate serves to hold the push-button in a depressed condition and in the scond position allows the push-button to extend to an alarm-actuating condition. A spring lever or its equivalent is provided which can be manually positioned to retain the plate member at its first position when the door is open. Upon the closing of the door the lever spring may be released so that only frictional engagement with the push-button serves to hold the plate at its first position. Upon opening of the door the plate moves to the second position, thus uncovering the push-button and allowing it to remain extended when the door is reclosed.

In the preferred embodiments, at its first position, the plate covers an aperture which receives the push-button and allows it to extend to an alarm-actuating condition. At the second position occupied by the slide the aperture is uncovered.

The plate is biased toward the second position by a suitable spring or, preferably, by gravity.

Thus, in accordance with the present invention, a complete wired perimeter burglar alarm system is provided for by combining the device described above with a make and break switch of the spring-loaded, push-button type, an alarm, a power source for actuating the alarm and a master switch for completing or breaking a circuit including the aforementioned components.

Accordingly, it is an object of the present invention to provide an inexpensive, simplified wired perimeter burglar alarm system.

It is a further object of the present invention to provide an adapter for use in conjunction with a push-button switch of the type conventionally used in wired perimeter burglar alarm systems, which adapter provides, mechanically, a function whereby once the alarm is triggered by the opening or closing of the conventional switch, it cannot be silenced simply by reclosing the passage through which entry was gained.

Other objects and further scope of applicability of the present invention will become apparent from the detailed description to follow, taken in conjunction with the accompanying drawing.

DESCRIPTION OF THE PREFERRED EMBODIMENTS

Figure 1:
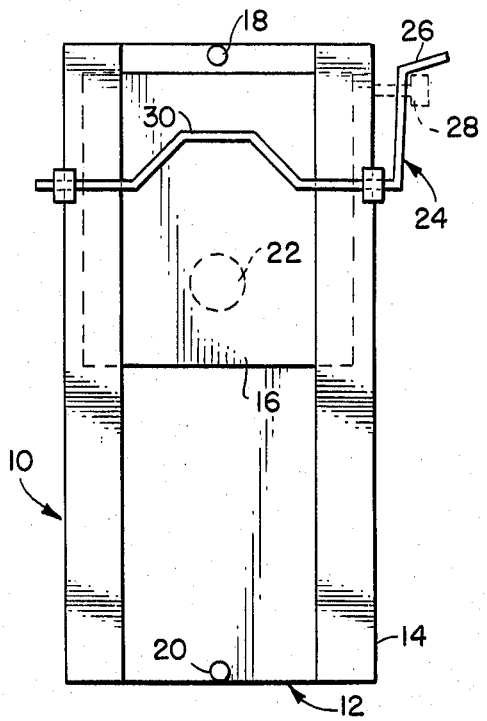
FIG. 1 is a front elevational view of one embodiment of the present invention in position to retain a push-button switch in a depressed, non-alarm-actuating condition.

FIG. 1 shows one embodiment of the adapter device of the present invention, generally designated by numeral 10. The device is shown as including a bracket member 12 which includes a pair of turned over flanges 14 serving to define a trackway in which plate member 16 slides. The travel of plate member 16 within bracket member 12 is limited by projections 18 and 20. Of course any alternative means for limiting the movement of the plate member 16 may be employed, such as, for example, top and bottom end plates which would serve to close the top and bottom of the bracket. In the embodiment depicted in FIG. 1 an aperture 22 is provided in bracket 12 of a diameter substantially larger than that of the push-button switch (not shown) with which the adapter is intended to mate. Aperture 22 must be sufficiently large that the fully extended push-button, mounted in a door jamb, will clear plate member 12 and enter aperture 22 upon the closing of the door with plate member 16 in the lowermost position as shown in FIG. 2.

In the mode shown in FIG. 1 plate 16 is retained at its uppermost position by frictional engagement with spring lever 24 which is shown locked in position by engagement between its arm 26 and a pin 28. In this condition rib 30 is in frictional engagement with the front surface of plate 16. In the mode shown in FIG. 2 arm 26 of spring lever 24 has been disengaged from pin 28, thereby disengaging rib 30 from plate 16 and plate 16 has fallen by gravity, to its lowermost position resting against protrusion 20.

Figure 2:
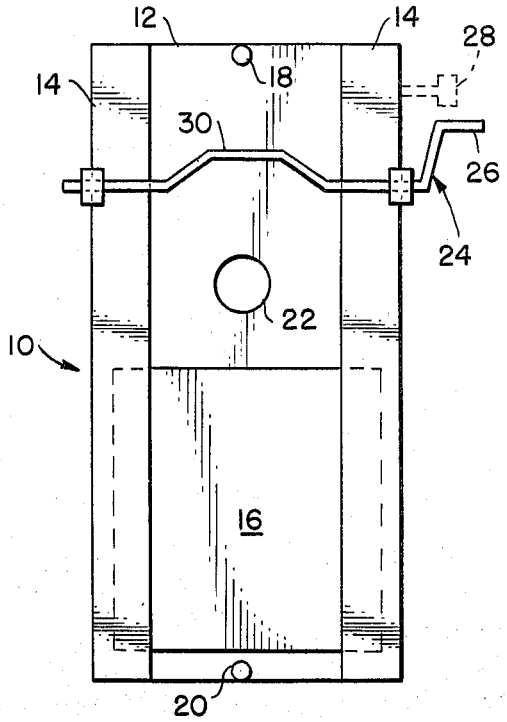
FIG. 2 is another front elevational view of the same device depicted in FIG. 1 but wherein the plate member is in a position designed to uncover a push-button switch and allow it to extend to an alarm-actuating condition.
Figure 4:
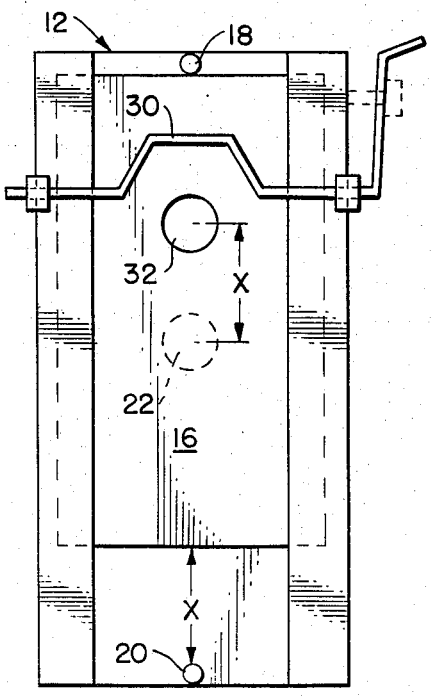
FIG. 4 is a front elevational view of another embodiment of the device of the present invention with its plate raised to an uppermost position.
Figure 3:
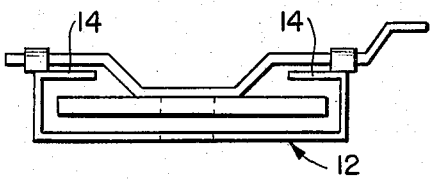
FIG. 3 is a cross-sectional view of the device of FIG. 1.

FIG. 4 shows an alternative embodiment of the device of the present invention which, like the device depicted in FIGS. 1–3, includes a bracket member 12 and a plate member 16. In the embodiment of FIG. 4 the plate member itself is provided with an aperture 32 which is designed to occupy an uppermost position above the push-button of the aforementioned switch when the plate 16 occupies the uppermost position, abutting protrusion 18. Upon release from engagement with rib 30 and from engagement with the push-button, as by the opening of a door on which the device is mounted, plate member 16 falls, by gravity, through a distance X to rest against protrusion 20. In that lowermost position the aperture 32 of plate 16 is in line with aperture 22 of bracket 12 and both are free to receive the extended push-button in the manner previously described in conjunction with FIG. 2.

Figure 5:
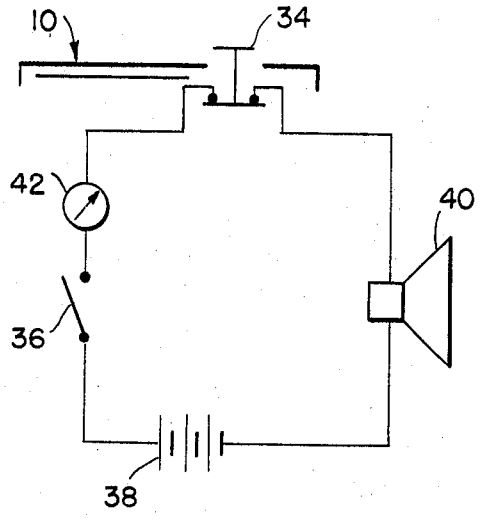
FIG. 5 is a schematic illustration of a burglar alarm circuit including the device of the present invention.

FIG. 5 illustrates the circuitry of a burglar alarm system used in conjunction with the adapter device previously described. Shown in FIG. 5 is a push-button switch 34 mounted, for example, in a door jamb for operative cooperation with device 10 mounted, for example, on the hinged edge of a door. The circuit further includes a master switch 36 which is optionally a knife edge type switch hidden in a location accessible from the exterior of the protected premises and a timer 42. A power source 38 is provided, shown in FIG. 5 as a battery but, alternatively, may be the alternating current available at the protected premises. Finally, the cicuitry includes an alarm 40, shown here as an audio type alarm which, as can be easily appreciated, may alternatively be a light flasher or a telephone connection or some combination of such alarms.

In use, prior to exiting through a passageway provided with adapter 10 mounted in cooperation with a push-button type switch, plate 16 is manually raised to its uppermost position and temporarily locked at that position by engagement of lever arm 26 with pin 28. Upon exiting and closing the passageway lever arm 26 is disengaged from pin 28 and master switch 36 is closed. With master switch 36 closed, any unauthorized entry through that passageway, i.e. by opening the door, will result in the plate dropping to its most lowermost position where the alarm cannot be silenced merely by reclosing the door.

Figure 6:
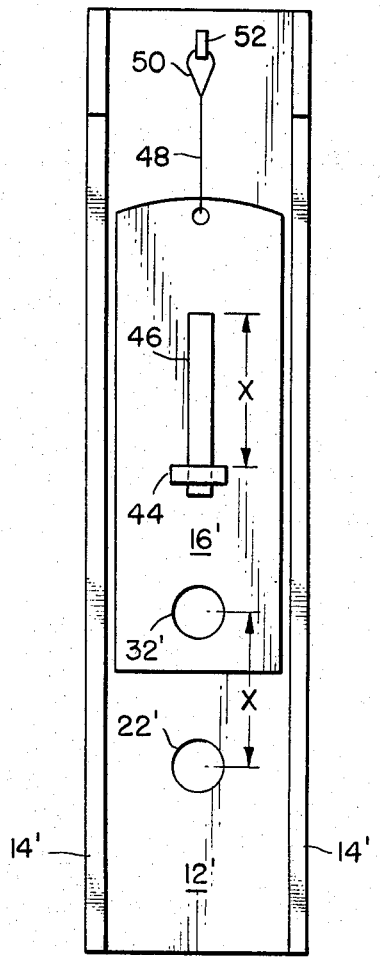
FIG. 6 is a front elevational view of yet another embodiment of the device of the present invention with its plate raised to an uppermost position.

FIG. 6 shows an embodiment with a less obtrusive means for arming the burglar alarm. Again, the device includes a bracket member 12′ provided with a pair of flanges 14′. In this embodiment the flanges 14′ extend at a right angle to the base of the bracket member 12′ and are not turned over as in the previously described embodiments. The travel of the plate member 16′ within the bracket member 12 is limited by a pin 44 affixed to bracket 12′ and extending through a slot 46 in the plate member 16′. As in the embodiment of FIG. 4, at the lowermost position of plate member 16′ its aperture 32′ is aligned with bracket aperture 22′. In this embodiment, on exiting through the door to which the adapter is affixed, the plate 16′ is held in its uppermost position by a string or fine filament 48 until the door is closed. For this purpose, the string 48 is manually held or affixed at some convenient point during the closing of the door. Once the door is closed, string 48 is manually released and allowed to hang within the crack between the door edge and the jamb. Optionally, string 48 may be provided at one end with a weight member 50 (or simply a loop) adapted to be hooked over pin member 52 when the burglar alarm is inactivated.

The invention may be embodied in other specific forms without departing from the spirit or essential characteristics thereof. For example, any selectively engagable means for temporarily holding plate 16 at its uppermost position while the door is open may be employed. The foregoing embodiments described in conjunction with the drawings are therefore to be considered in all respects as illustrative and not restrictive, the scope of the invention being indicated by the appended claims rather than by the foregoing description and all changes which come within the meaning and range of equivalency of the claims are therefor intended to be embraced therein.

What is claimed is:

1. A device for use in a doorway in conjunction with a make and break switch of the spring-loaded, push-button type, the push-button switch forming part of a wired perimeter burglar alarm system, said device comprising:

a plate member;

mounting means, secured in a position for cooperation with the push-button switch, for providing a vertical trackway for sliding movement of said plate member between a first position for engaging the push-button switch when the door is closed to hold the push-button in a depressed condition and a second position where said plate member does not engage the push-button switch when the door is closed;

retaining means for selectively holding said plate member at said first position when the door is open; and, means for manually releasing said retaining means while the door is closed so that, upon opening the door, said plate moves to said second position.

2. The apparatus of claim 1 wherein said plate is provided with an aperture for allowing extension of the push-button therethrough.

3. The apparatus of claim 2 wherein said mounting means is provided with a second aperture, which aligns with said aperture in said plate when said plate is at the second position, for receiving the push-button.

4. The device of claim 1 wherein said first and second positions are vertically spaced with said first position being located above said second position, whereby said plate moves from said first position to said second position by gravity.

5. A burglar alarm system including the device of claim 1 and further comprising:

a doorway mounted make and break switch including a spring-loaded, push-button which engages and holds said plate member at its upper position while the door is closed;

an alarm;

a power source which activates said alarm responsive to said spring-loaded, push-button switch; and, a second, manually operable switch for completing or breaking the circuit including said power source, said spring-loaded push-button switch and said alarm.

6. The device of claim 1 wherein a string, filament or wire substitutes said retaining means and said releasing means.

* * * * *